US006421860B1

(12) United States Patent
Abbott

(10) Patent No.: US 6,421,860 B1
(45) Date of Patent: Jul. 23, 2002

(54) PAINTER'S TOOL

(76) Inventor: Phillip G. Abbott, 819 Mimosa Heights Dr., Louisville, Blount County, TN (US) 37777

( * ) Notice: Subject to any disclaimer, the term of this patent is extended or adjusted under 35 U.S.C. 154(b) by 25 days.

(21) Appl. No.: 09/637,976

(22) Filed: Aug. 11, 2000

(51) Int. Cl.[7] ..... B44C 7/00
(52) U.S. Cl. ..... 7/105; 7/165; 15/105
(58) Field of Search ..... 7/105, 165, 167; 15/105, 236.03

(56) References Cited

U.S. PATENT DOCUMENTS 4,324,018 A * 4/1982 Olsson ..... 15/236.03
4,553,279 A * 11/1985 Gassew et al. ..... 7/105
5,251,352 A * 10/1993 Cullison ..... 7/105
5,272,782 A * 12/1993 Hutt ..... 15/236.03 X
5,546,625 A * 8/1996 Mealey ..... 7/105 X
5,870,786 A * 2/1999 Papadopoulos ..... 7/105
6,009,581 A * 1/2000 Davis ..... 7/105

* cited by examiner

*Primary Examiner*—James G. Smith
(74) *Attorney, Agent, or Firm*—Pitts & Brittian, P.C.

(57) ABSTRACT

A painter's tool providing multiple functions is disclosed for a painter's use in preparing a surface for painting, for opening containers, and for cleaning utensils. The tool includes a blade connected to a handle. The distal end of the blade includes a beveled edge bounded by a first squared corner for gouging holes and a second pointed corner for gouging cracks. The blade includes a first edge having a plurality of teeth along the first edge for cleaning a paint brush. The first edge extends outwardly at an angle from the handle toward the squared corner, thereby allowing ergonomic gripping of the handle while cleaning a brush or gouging with a blade corner. The blade includes an arcuate second edge having an inwardly curved surface for cleaning a paint roller, and having a projection and a notch for opening containers. The painter's tool provides multiple functions in one hand-held unit, and reduces the need for a painter to carry additional tools while painting.

18 Claims, 3 Drawing Sheets

PAINTER'S TOOL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

The invention relates to a tool for painters. More specifically, the invention relates to an apparatus having a combination of uses for assisting a painter.

2. Description of the Related Art

Prior devices have provided a variety of shapes of tools that are utilized by painters in painting operations to assist with tasks such as scraping, spreading, cutting, opening paint cans, pulling nails, and similar tasks. In general, prior tools include a blade end for scraping paint, a nail puller hole in the blade, and a handle for manipulating the blade end. Prior tools can include foldable blades, or fixed blades in varying lengths to extend the reach of the painter without being cumbersome to carry in a pocket or a belt worn by the painter.

An example of the prior art is U.S. Pat. No. 5,979,058, issued to Henke, which discloses a multi-purpose hand tool for use by a painter for scraping and spreading putty, and cutting or sawing surfaces to be painted. The hand tool lacks a curved surface for cleaning paint rollers, and lacks an elongated, convoluted side for cleaning paint brushes, therefore requiring the painter to carry additional tools for completion of a repetitive painting activity related to cleaning painting utensils.

A further example of the prior art is U.S. Pat. No. 5,870,786, issued to Papadopoulos, which discloses a utility tool for use by a painter for scraping surfaces, cleaning rollers, and pulling nails. The utility tool lacks a convoluted surface for cleaning paint brushes, therefore requiring the painter to carry additional tools for completion of a repetitive painting activity related to cleaning painting utensils.

The prior tools for painters typically include edges for scraping paint off of surfaces, and for scraping paint off of paint roller tubes, or for prying cans open with the scraping edge. If various sized cans or other containers of paint are used by a painter, then multiple utility tools must be carried by the painter to accomplish the many operations that the painter must perform with one hand, while utilizing the other hand to hold onto a ladder or other platform during preparation for painting and cleanup of painting utensils.

Therefore, it is an object of the present invention to provide a hand-held tool having a plurality of uniquely configured surfaces for beneficial use by a painter.

It is another object of the present invention to provide an improved utility tool providing a plurality of indentations for cleaning multiple sizes of painting utensils.

It is another object of the present invention to provide a hand-held painter's tool having a multi-configured blade end for preparing surfaces for painting, and having multiple edges for opening a variety of containers.

It is another object of the present invention to provide an improved painter's tool for cleaning brushes and paint rollers, for opening multi-sized containers, and for preparing surfaces for painting.

BRIEF SUMMARY OF INVENTION

In accordance with the present invention, there is provided a painter's tool configured for providing multiple functions in one hand-held unit for use by a painter. The painter's tool provides elements for preparing a surface for painting, for opening multi-sized paint containers, and for cleaning painting utensils in a structural configuration that provides for efficient use by a painter. The painter's tool includes a blade attached at a proximal end to a handle, with the blade including a distal end having a beveled scraper end being bounded by a pointed corner and a squared corner. The blade includes a first side surface having a plurality of teeth extending from the squared corner of the distal end, to the handle end of the blade. The plurality of teeth providing a convoluted surface for cleaning multiple sizes of paint brushes. The first side surface is angled outwardly from the handle end of the blade toward the distal end of the blade.

The blade includes a second side surface having an arcuate surface extended from the pointed corner, along a mid-portion that curves inwardly toward the midline of the blade in a concave shape, and ending at the handle end of the blade. The arcuate surface includes a projection proximate the curved mid-portion for opening a container lid opener, and includes a sharpened cutter edge proximate the pointed corner, thereby providing a pointed gouger having an edge for cutting materials and for prying in surfaces for removing cracked paint. The gripping end of the handle includes an end plate for setting nails into surfaces to be painted.

BRIEF DESCRIPTION OF SEVERAL VIEWS OF DRAWINGS

The above mentioned objects and advantages of the present invention are readily apparent from description of the invention contained herein, and by reference to the claims, read together with the drawings in which:

DETAILED DESCRIPTION OF THE INVENTION

Figure 1:
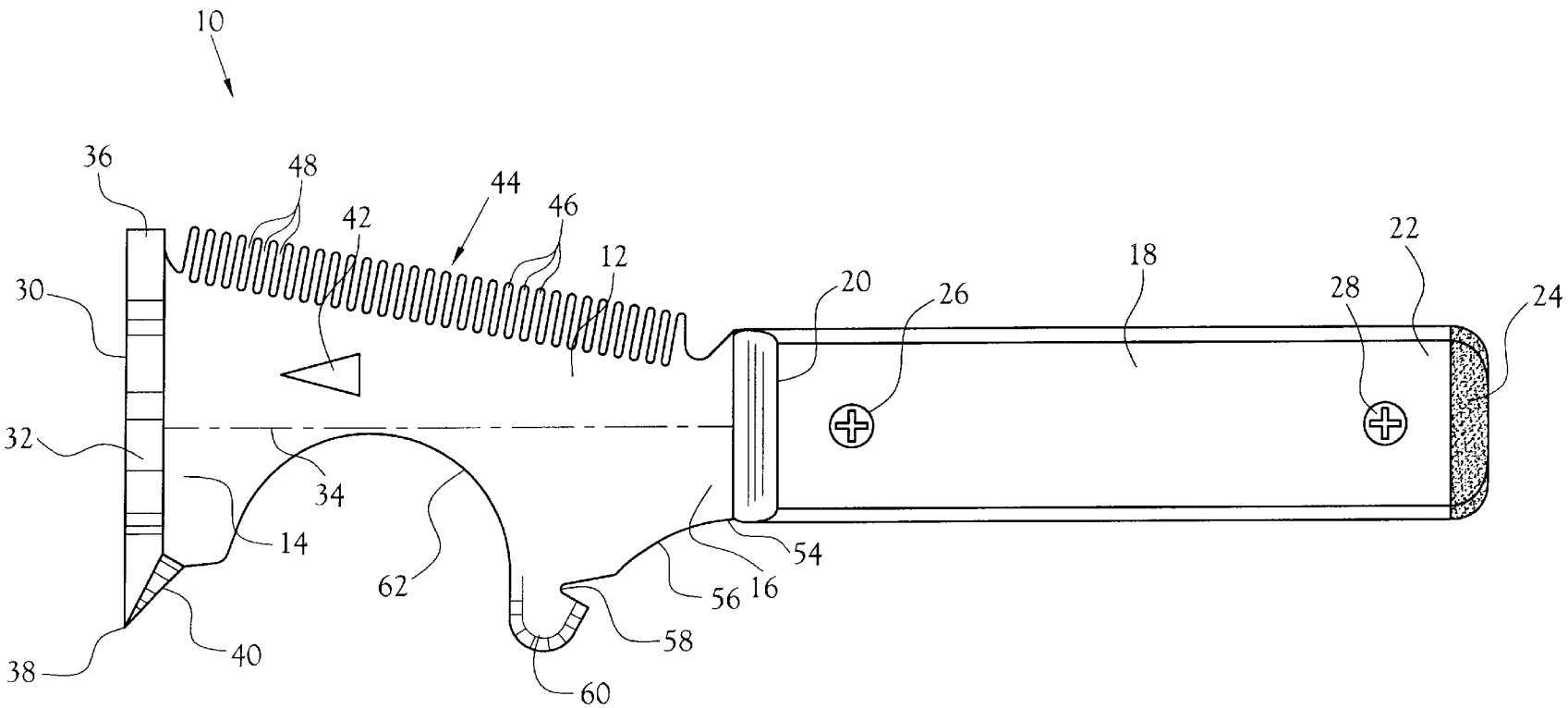
FIG. 1 is a side view of one embodiment of the painter's aid, illustrating the plurality of features provided by the present invention.
Figure 2:
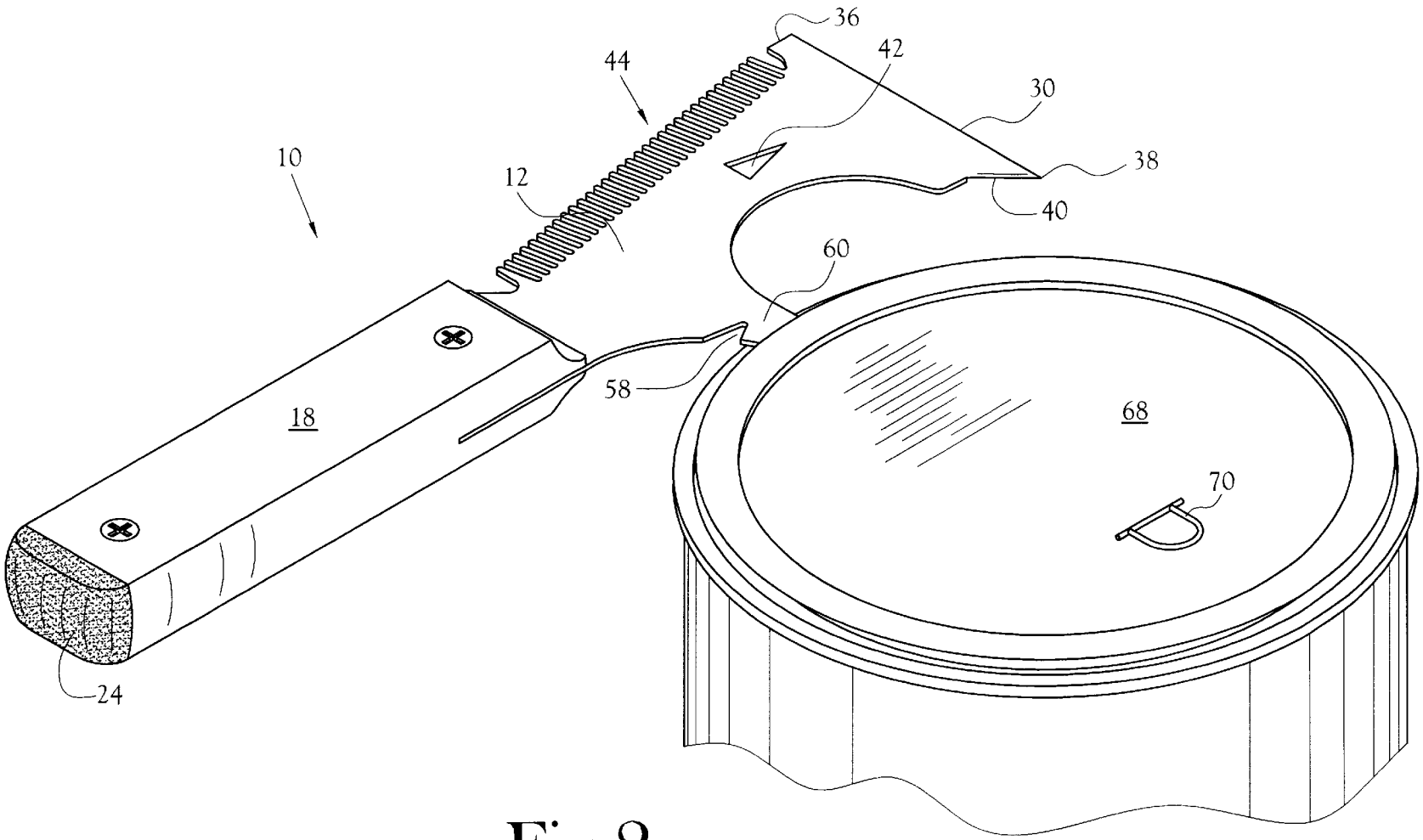
FIG. 2 is a side perspective view of the painter's aid of FIG. 1 being utilized to assist the painter with opening containers.
Figure 3:
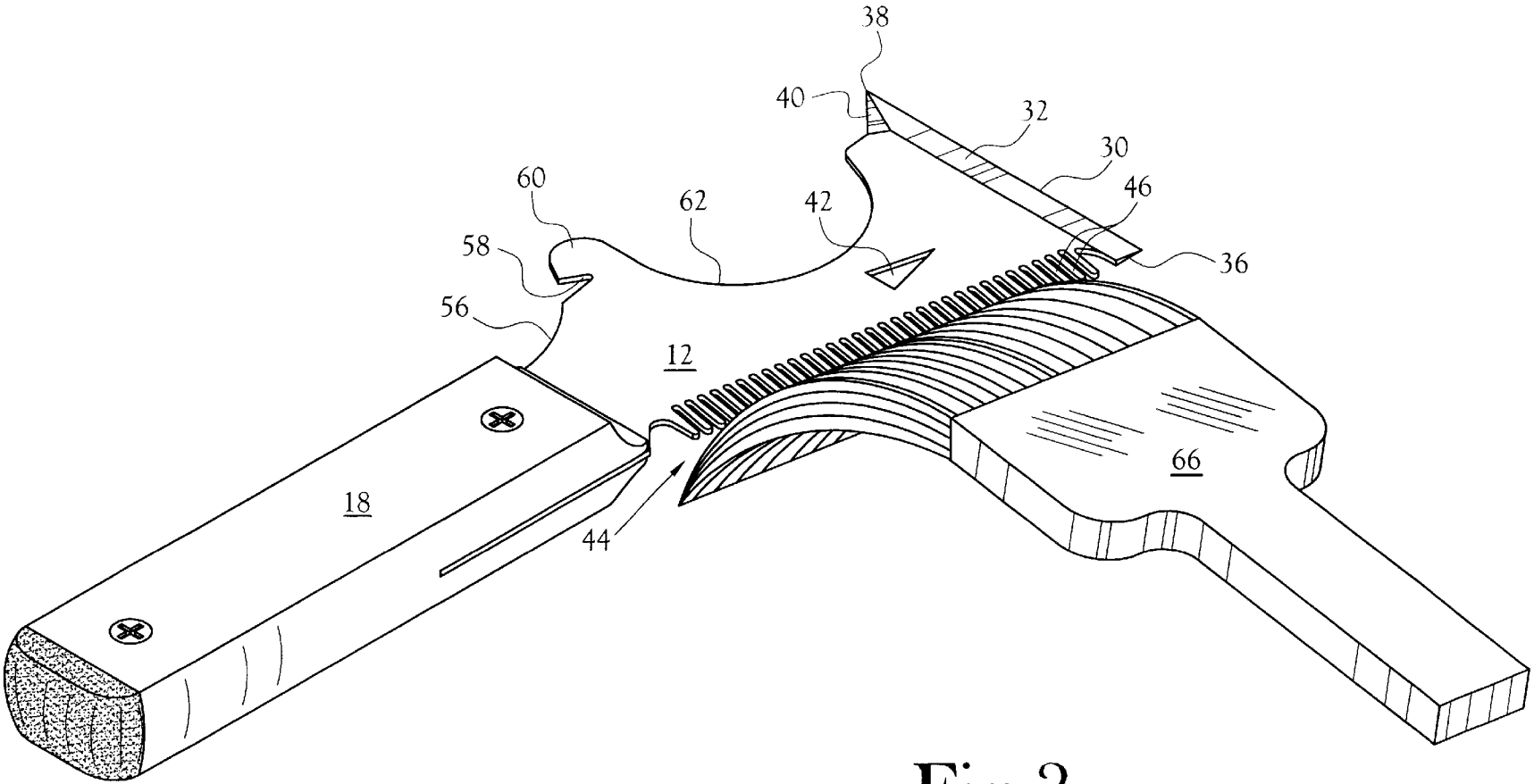
FIG. 3 is an front perspective view of the painter's aid of FIG. 1 being utilized to assist the painter with cleaning a brush or a roller.

In accordance with the present invention, there is provided a painter's tool configured for providing multiple functions in a hand-held unit for use by a painter in preparing surfaces for painting, for opening multi-sized paint containers, and for cleaning painting utensils. As illustrated in FIGS. 1–3, one embodiment of the painter's tool 10 includes a blade 12 having a distal end 14 for scraping and spreading of putty, and having a second end, or medial portion 16 shaped and sized to fit into a handle 18. The handle is generally rectangular in cross-section, or an alternative shape to fit into the hand of the user, and includes a blade end 20 proximate the medial portion 16 of the blade, and includes an opposed second or base end 22 having a strike plate 24 with an appropriate sized and shaped cross-section to be removably attachable to the base end 22. The strike plate 24 includes a flattened and hardened exterior end for striking and setting nails into a surface to be painted. The distal end 14 of the blade 12 inserts into the blade end 20 of the handle 18, with the blade 12 being removably fastened into the handle by connectors 26, 28 that are removably insertable through the handle 18. The connectors 26, 28 can be located along the longitudinal centerline of the handle 18. The painter's tool 10 is preferably of a length of about six inches to about nine inches extending from the distal end 14 to the exterior end of the strike plate 24, with the handle 18 being sized at about four inches to about five inches in length, and shaped with a rectangular or a similar shape in cross-section to be easily grasped by a painter. The wider portion of the handle 18 is oriented parallel with the wide portion of the blade 12 so that the painter's tool 10 can be inserted flat into a painter's pants pocket, or into an accessory belt pocket, or placed onto a belt hook to hang proximate the painter from a ladder or from an accessory belt. The blade 12 is preferably of a width of about two inches to about two and a half inches across the distal end 14 of the blade 12.

The distal end 14 includes a generally straight edge 30 for spreading putty, and/or paint, and/or for scrapping dried paint off surfaces. One side of the distal end 14 can be beveled to provide a scraper side for removing excess dried and/or cracked paint from the surface to be painted. The beveled edge 32 of the straight edge 30 is bounded by a first corner 36 being generally configured as a squared corner, and a second corner 38 being generally configured as a pointed corner (see FIG. 1). The pointed corner 38 provides the function of gouging putty and/or dried paint from cracks or small sized holes in the surface being painted, and the squared first corner 36 provides the function of gouging or routing out putty and/or dried paint from large sized holes in the surface being painted. The leading edge of the pointed second corner 38 and the leading edge of the squared first corner 36 are both contiguous with the beveled edge 32 of the straight edge 30. The trailing edge 40 of the pointed corner 38 is angled inwardly toward the medial portion 16 of the blade of the blade, with the trailing edge 40 being beveled to provide a sharpened cutter edge for use in cutting of tape, string, or other materials utilized by a painter in preparing or masking of surfaces to be painted.

The blade 12 includes a midline 34 that bisects the blade and is aligned with the longitudinal centerline of the handle 18. Proximate the midline 34 is positioned an opening 42 of a generally triangular or elongated shape. The opening 42 provides an elongated hole that can be utilized to remove nails or other projections from surfaces to be painted by inserting a nail head through the opening 42 and prying the nail out of the surface by manipulating the painter's tool by a leverage action with the distal end 14 as the fulcrum. The opening 42 can also provide an elongated hole for inserting the blade onto a hook or clip on the painter's belt for convenient access by the painter while on a ladder or scaffolding.

The blade 12 includes a first side 44 that can be generally straight as extended from the handle, or in a preferred embodiment is angled outwardly along first side 44 from the medial portion 16 of the blade to the squared first corner 36 of the blade 12. The angled first side 44 provides additional structural integrity of the blade 12 by increasing the width at the straight edge 30 to accommodate a combination of features that are included in the blade along and between the first side 44 and the second side 54. The first side 44 is about three and a third inches to about four inches in length, and includes a plurality of teeth 46 of about three inches to about three and two-thirds in length. Each respective tooth is about 0.050 inches in width, and is separated by indentations 48 that have approximately the same separation of about 0.050 inches between each tooth. The plurality of teeth 46 provide a convoluted surface for removing excess paint from a paint brush 66 (see FIG. 3), and cleaning or straightening the bristles of the paint brush 66. Due to the orientation of the first side 44 being outwardly angled in relation to the midline 34 of the blade 12, the squared corner 36 extends outwardly above the extended longitudinal plane of the first side surface of the handle, thereby allowing a painter to grip the handle while providing leverage during gouging and manipulation of the squared corner 36 without bumping the painter's knuckles against the surface to be cleaned before painting. The outwardly angled first side 44 further provides for a painter to grip the handle while manipulating the plurality of plurality of teeth 46 for straightening and cleaning the bristles of a paint brush 66 (see FIG. 3).

A second side 54 includes sequentially, beginning at the medial portion 16, a curved portion 56, a notch portion 58, a projection 60, and a concave portion 62 being generally curved inwardly toward the midline 34, with the second side 54 extending outward to the pointed corner 38. The notch portion 58 provides the painter's tool 10 with the ability to open a paint container having a tab "D" ring 70 (see FIG. 2), or other tab projection from the paint container top 68. The projection 60 provides a rounded edge that can provide a reinforced can opener projection 60 for prying and opening any sized large, medium, or small volume container having a can top rim depressed into a circumferential upper cylindrical trough of the paint container. The projection 60 can have a side edge that is beveled and is utilized to screw connectors or fasteners into the surface to be painted. The combination of the notch portion 58 and the projection 60 provides an additional usefulness of a can opener and/or bottle opener positioned close to the medial portion 16 to provide a means for efficient application of leverage by the painter when holding the handle 18 and attempting to open a container such as a paint can or bottle. The concave portion 62 provides a paint roller cleaning means for removal of excess paint or unwanted contaminants from a paint roller.

The multi-purpose painter's tool 10 (see FIG. 1) provides between nine and ten functions in one hand-held unit for use by a painter. The functions of the painter's tool 10 include: (a) the nail strike plate 24 providing a hammer function; (b) the beveled edge 32 providing a scraper of paint and a spreader of caulking; (c) the pointed corner 38 providing a gouger of cracks and small holes; (d) the squared corner 36 providing a gouger function and a means for screwing screws; (e) the trailing edge 40 providing a cutter edge; (f) the opening 42 for pulling nails and staples or for attaching the blade to a hook on the painter's belt; (g) the plurality of teeth 46 providing a brush cleaning means; (h) the notch portion 58 providing a bottle top opener or tab top opener; (i) the projection 60 providing a lever for prying open container cans and a second means for screwing screws; and (j) the concave portion 62 providing a roller cleaning means. Therefore, the compact configuration of the elements along the perimeter of the blade 12, plus the nail puller 42 and nail strike plate 24, provides a painter's tool 10 that is conveniently carried in a pocket of the painter, and reduces the need for the painter to carry additional tools other than the painter's tool 10, a paint brush 66, and/or a paint roller, and a paint container while painting on a ladder or scaffolding.

An alternative embodiment includes a painter's tool including a blade 12 having a first side 44 that can be generally straight as extended from the handle (see FIG. 3), with the plurality of teeth 46 having rounded teeth to minimize the cutting of paint brush bristles when the paint brush 66 is moved across the plurality of teeth 44. A preferred alternative embodiment provides a first side 44 being angled outwardly from the medial portion 16 of the blade to the squared first corner 36 of the blade 12 (see FIG. 1 and 2). The outwardly angled first side 44 provides additional structural integrity of the blade 12 by increasing the width at the straight edge 30 to accommodate a combination of features that are included in the blade along and between the first side 44 and the curved portion 56 of the second side 54. The outwardly angled first side 44 allows for a painter to hold the painter's tool 10 in one hand, while manipulating a painting utensil across the first side 44 at an angle of less that a right angle (90° ) of the hand holding the painting utensil, therefore maintaining an ergonomic orientation between the painting utensil and the painter's tool held in separate hands while manipulating the plurality of teeth 46 for straightening and cleaning the bristles of a paint brush 66.

From the foregoing description, additional advantages over the prior devices will be recognized by those skilled in the art for the improved painter's tool of the present invention. While a preferred embodiment is shown and described, it will be understood it is not intended to limit the disclosure of the invention, but rather it is intended to cover all modifications and alternate devices and methods of operating falling within the spirit and scope of the invention as defined in the appended claims.

What is claimed is:

1. A utility tool for use by a painter for preparation of a surface to be painted, comprising:

a blade having a first end, a second end, and a midline extended along said blade between said first end and said second end, said first end defining a scraper edge bounded by a first corner and a second corner, whereby said scraper edge utilized to scrape the surface to be painted;

a handle having a first end and a second end, said first end of said handle attached to said second end of said blade, said second end of said handle including a strike plate removably attachable to said second end, whereby said strike plate utilized to set a nail into the surface to be painted;

a first side of said blade extended from said second end of said blade to said first corner of said first end of said blade, said first side including a plurality of teeth extending along said first side, whereby said plurality of teeth utilized to clean a paint brush contacted against said plurality of teeth, said first side extended outwardly from said second end of said blade toward said first end of said blade, whereby said first end of said blade is wider than said second end of said blade, whereby said plurality of teeth utilized to clean and straighten a paint brush contacted against said plurality of teeth;

a second side of said blade, said second side opposed to said first side, said second side extended from said second end of said blade to said second corner of said first end of said blade, said second side having a mid-portion curved inwardly toward said midline of said blade, whereby said curved mid-portion is utilized to clean a paint roller contacted against said curved mid-portion;

said scraper edge further including said scraper edge beveled on one side, said beveled scraper edge bounded by said first corner being squared, and said second corner being pointed, said second corner having a trailing side angled inwardly toward said midline of said blade, said trailing side positioned between said second corner and said curved mid-portion, said trailing side having a sharpened edge, whereby said sharpened edge utilized for cutting materials by the painter; and a projection positioned between said curved mid-portion of said second side and said second end of said blade, said projection curved outwardly from said midline of said blade, whereby said projection utilized to pry open containers.

2. The utility tool according to claim 1, wherein said second side of said blade further including a notch recessed into said second side, said notch positioned between said projection and said second end of said blade, said notch angled inwardly into said blade, whereby said notch is utilized to pull open container tops.

3. The utility tool according to claim 1, wherein said first side further includes an indent positioned into said first side between said squared first corner and said plurality of teeth extending along said first side, said indent spaced apart from said plurality of teeth whereby said squared first corner utilized to gouge out holes in the surface to be painted, and said squared first corner used to pry open containers.

4. The utility tool according to claim 1, wherein said projection further including a side edge being beveled, whereby said projection is utilized to pry open containers.

5. A utility tool for use by a painter for preparation of a surface to be painted, comprising:

a blade having a first end, a second end, and a midline extended along said blade between said first end and said second end, said first end defining a scraper edge bounded by a first corner and a second corner, whereby said scraper edge is utilized to scrape the surface to be painted;

an elongated handle having a first end and a second end, said first end attached to said second end of said blade;

a first side extended outwardly from said second end of said blade toward said first end of said blade, whereby said first end of said blade is wider than said second end of said blade, said first side including a plurality of teeth extending along said first side, whereby said plurality of teeth is utilized to clean a paint brush contacted against said plurality of teeth;

a second side opposed said first side of said blade, said second side having a curved mid-portion curved inwardly toward said midline of said blade, whereby said curved mid-portion is utilized to clean a paint roller contacted against said curved inwardly mid-portion;

a projection positioned between said curved mid-portion and said second end of said blade, said projection curved outwardly, whereby said projection is utilized to pry open containers;

a notch recessed into said second side, said notch positioned between said projection and said second end of said blade, said notch angled inwardly of said blade, whereby said notch is utilized to pull open container tops; and an opening through said blade, said opening positioned along said midline of said blade, said opening proximate said first end, whereby said opening is utilized to pull nails from surfaces to be painted, or to attach said blade proximate the painter for convenient access by the painter.

6. The utility tool according to claim 5, wherein said scraper edge further including said scraper edge beveled on one side, said beveled scraper edge bounded by said first corner being squared in shape, and said second corner being pointed in shape, said second corner having a trailing side angled inwardly toward said midline of said blade, said trailing side positioned between said second corner and said curved mid-portion, said trailing side having a sharpened edge, whereby said sharpened edge is utilized for cutting materials by the painter.

7. The utility tool according to claim 6, wherein said squared first corner further includes an indent positioned into said first side between said squared first corner and said plurality of teeth extending along said first side, said first side being outwardly angled from said second end of said blade in relation to said midline of said blade, said indent spaced apart from said plurality of teeth whereby said squared first corner is utilized to gouge out holes in the surface to be painted and to pry open containers.

8. The utility tool according to claim 5, wherein said protection further including an edge of said projection being beveled, whereby said projection edge is utilized to pry open containers.

9. A painter's tool for use by a painter for preparation of a surface to be painted and to clean paint brushes and paint rollers, comprising:

a blade having a first end, a second end, and a midline extended along said blade between said first end and said second end, said first end defining a scraper edge beveled on one side of said scraper edge, said beveled scraper edge bounded by a first corner and a second corner, whereby said beveled scraper edge is utilized to scrape the surface to be painted;

an elongated handle having a first end and a second end, said first end attached to said second end of said blade, and said second end having a strike plate removably attachable to said second end, whereby said strike plate is utilized to set a nail into the surface to be painted;

a first side extended from said second end of said blade to said first end of said blade, whereby said first end of said blade is wider than said second end of said blade, said first side having a plurality of teeth extending along said first side, whereby said plurality of teeth is utilized to clean a paint brush;

a second side opposite said first side of said blade, said second side having a curved mid-portion curved inwardly toward said midline of said blade, whereby said curved mid-portion is utilized to clean a paint roller;

a projection positioned between said curved mid-portion and said second end of said blade, said projection curved outwardly, said projection having one side being beveled, whereby said projection is utilized to pry open containers; and a notch recessed into said blade second side, said notch positioned between said projection and said second end of said blade, said notch angled inwardly of said blade, whereby said notch is utilized to pull open the tops of containers.

10. The painter's tool according to claim 9, wherein said blade including an opening therethrough said blade, said opening positioned along said midline of said blade, said opening proximate said first end, whereby said opening is utilized to pull nails, or to attach said blade proximate the painter for convenient access by the painter.

11. The painter's tool according to claim 9, wherein said second corner includes a pointed corner having a trailing side angled inwardly toward said midline of said blade, said trailing side positioned between said second corner and said curved mid-portion, said trailing side having a sharpened edge, whereby said sharpened edge is utilized for cutting materials by the painter.

12. The painter's tool according to claim 9, wherein said first corner includes a square corner having an indent positioned into said first side between said first corner and said plurality of teeth extending along said first side, said indent spaced apart from said plurality of teeth whereby said square first corner is utilized to gouge out holes in the surface to be painted and is utilized to pry open containers.

13. A utility tool for use by a painter, comprising:

a blade having a first end, a second end, and a midline extended along said blade between said first end and said second end, said first end defining a scraper edge bounded by a first corner and a second corner;

a handle removable attached to said second end of said blade;

a first side of said blade extended from said second end of said blade to said first corner of said first end of said blade;

a second side of said blade extended from said second end of said blade to said second corner of said first end of said blade, said second side having a mid-portion curved inwardly toward said midline of said blade, said second side of said blade including a projection positioned between said curved mid-portion of said second side and said second end of said blade, said projection curved outwardly from said midline of said blade, said projection having one side being beveled, whereby said projection is utilized to pry open containers; and a plurality of teeth extending along said first side, whereby said plurality of teeth being utilized to clean a paint brush contacted against said plurality of teeth.

14. The utility tool according to claim 13, wherein said scraper edge including said scraper edge beveled on one side, said beveled scraper edge bounded by said first corner being squared, and said second corner being pointed, said second corner having a trailing side angled inwardly toward said midline of said blade, said trailing side positioned between said second corner and said curved mid-portion, said trailing side having a sharpened edge, whereby said sharpened edge is utilized for cutting materials by the painter.

15. The utility tool according to claim 14, wherein said second side of said blade further including a notch recessed into said second side, said notch positioned between said projection and said second end of said blade, said notch angled inwardly into said blade, whereby said notch is utilized to open container tops.

16. The utility tool according to claim 15, wherein said handle including a blade end and a second end having a strike plate removably attachable to said second end, whereby said strike plate is utilized to set a nail into the surface to be painted.

17. The utility tool according to claim 15, wherein said blade including an opening therethrough said blade, said opening positioned along said midline of said blade, said opening proximate said first end, whereby said opening is utilized to pull nails from surfaces to be pained, or to attach said blade proximate the painter for convenient access by the painter.

18. The utility tool according to claim 15, wherein said first side including an indent positioned into said first side between said squared first corner and said plurality of teeth extending along said first side, said first side being outwardly angled in relation to said midline of said blade, said indent spaced apart from said plurality of teeth whereby said squared first corner is utilized to gouge out holes in the surface to be painted, and said squared first corner is utilized to pry open containers.

* * * * *